United States Patent [19]

Amagami et al.

[11] 4,129,767

[45] Dec. 12, 1978

[54] INDUCTION HEATING APPARATUS HAVING TIMING MEANS RESPONSIVE TO TEMPORARY REMOVAL OF COOKING IMPLEMENT

[75] Inventors: Keizo Amagami; Masatatsu Nakamura; Hideyuki Kominami; Kouji Funakoshi; Mitsuyuki Kiuchi; Takumi Mizukawa, all of Kadoma, Japan

[73] Assignee: Matsushita Electric Industrial Company, Limited, Japan

[21] Appl. No.: 818,322

[22] Filed: Jul. 22, 1977

Related U.S. Application Data

[63] Continuation-in-part of Ser. No. 587,706, Jun. 17, 1975, abandoned.

[51] Int. Cl.[2] ..... H05B 5/04

[52] U.S. Cl. ..... 219/10.49 R; 219/10.77; 363/57

[58] Field of Search ..... 219/10.49, 10.77, 10.75; 363/57, 74, 78, 95; 307/31, 33, 100

[56] References Cited

U.S. PATENT DOCUMENTS

| | | | |
|---|---|---|---|
| 3,604,882 | 9/1971 | Seyfried | 219/10.77 |
| 3,796,850 | 3/1974 | Moreland et al. | 219/10.49 |
| 3,823,297 | 7/1974 | Cunningham | 219/10.77 |
| 3,870,847 | 3/1975 | Shields | 219/10.77 |
| 3,886,342 | 5/1975 | Peters | 219/10.49 |
| 3,919,621 | 11/1975 | Wechsler | 363/57 |
| 3,925,633 | 12/1975 | Partridge | 219/10.77 |

*Primary Examiner*—Bruce A. Reynolds

*Attorney, Agent, or Firm*—Robert E. Burns; Emmanuel J. Lobato; Bruce L. Adams

[57] ABSTRACT

A plurality of switches each is provided in the vicinity of each of a plurality of heater coils of an induction heating apparatus, and responsive to removel of a cooking implement from a corresponding heater coil for being rendered open. A plurality of timers each is connected to each of the switches and causes the heater coil to be de-energized when the cooking implement is kept away from the heater coil for more than a predetermined time period.

1 Claim, 5 Drawing Figures

INDUCTION HEATING APPARATUS HAVING TIMING MEANS RESPONSIVE TO TEMPORARY REMOVAL OF COOKING IMPLEMENT

This invention is a continuation-in-part of application Ser. No. 587,706 filed on June 17, 1975 and now abandoned.

FIELD OF THE INVENTION

The present invention relates to an induction heating apparatus typically utilized for cooking purpose.

BACKGROUND OF THE INVENTION

The induction heating apparatus to which the present invention apertains is largely composed of a static power inverter and an induction heating unit which comprises a plurality of heater coils connected between the output terminals of the power inverter. The static power inverter comprises a semiconductor switching circuit consisting of a parallel combination of a silicon controlled rectifier and a diode which are connected in reverse directions to each other. Across the semiconductor switching circuit is connected an oscillating circuit consisting of a commutating inductor and a commutating capacitor so that a high-frequency oscillating current is produced when the silicon controlled rectifier forming part of the switching circuit is triggered at a predetermined frequency. A resonance current is consequently produced in each of the heater coils which usually are connected in parallel between the output terminals of the static power inverter or, more exactly, across the above mentioned commutating capacitor so that a commutating magnetic field is induced by each of the heater coils. The commutating magnetic field produces eddy currents in a cooking pan, pot or kettle placed in the vicinity of each of the heater coils with the result that the material to be cooked is heated directly from the cooking implement in which the material is contained.

According to the prior art, however, when the cooking implement is temporarily removed from a top plate positioned above the heater coils in the process of cooking, the heater coil associated with the removed cooking implement is undesirably and instantly deenergized. Furthermore, the de-energized heater coil affects inversely overall load impedance of the induction heating unit when the plurality of heater coils are driven by single static power inverter.

SUMMARY OF THE INVENTION

The present invention sets forth a new concept in an induction heating apparatus for removing the above-mentioned defects inherent in the prior art. The apparatus embodying the present invention comprises: a d.c. power supply circuit; a static power inverter connected to the d.c. power supply circuit for producing a high-frequency oscillating current; an induction heating unit having a plurality of heater coils connected to the static power inverter for producing a commutating magnetic field around each of the heater coils; capacitors respectively connected in series with the heater coils; a plurality of first switches each connected between the static power inverter and each of the heater coils; a plurality of second switches each provided in the vicinity of each of the plurality of the heater coils and responsive to removal of a load to be heated from its corresponding heater coil to be rendered open; a plurality of timing circuits respectively connected in series with the second switches, each of the timing circuits producing an output signal in response to a condition in which the corresponding one of the second switches is kept open for a predetermined period of time; a switch control circuit having input terminals connected to the timing circuits, being linked with the first switches through respective linkage linking the first switches to the switch control circuit, and being actuated by the output signal from each of the timing circuits so that the first switch associated with the timing circuit delivering the output signal is rendered open; and a plurality of third switches connected in series and provided between junctions defined by the capacitors and the heater coils, each of the third switches being linked to the switch control circuit through respective said linkages for being rendered open when the first switch associated with the timing circuit delivering the output signal is rendered open by means of the switch control circuit.

DESCRIPTION OF THE PREFERRED EMBODIMENT

Figure 1:
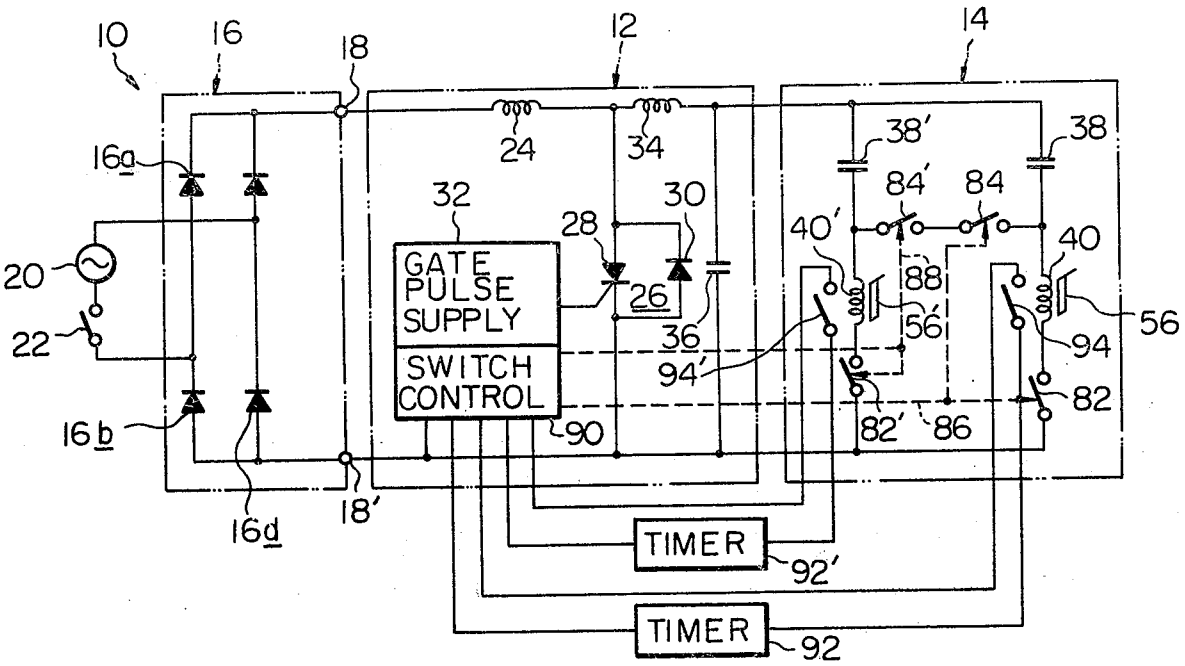
FIG. 1 is an illustration of a preferred embodiment of the present invention.

Throughout the drawings and the following description like parts are designated by the same reference numerals.

Reference will now be made to the drawings, first to FIG. 1 in which a preferred embodiment of the induction heating apparatus according to the present invention is illustrated. As shown, the induction heating apparatus largely comprises a d.c. power supply circuit 10, a static power converter 12 and an induction heating unit 14. The d.c. power supply circuit 10 is shown to be composed, by way of example, a bridge-type full-wave rectifier 16 having positive and negative output terminals 18 and 18' and a series combination of an a.c. power source 20 and a manually-operated switch 22 connected across the full-wave rectifier 16. The full-wave rectifier 16 consists of diodes **16*a*, 16*b*, 16*c* and 16*d* which are connected in a diametric bridge form between the positive and negative output terminals 18 and 18' of the full-wave rectifier 16. The static power converter 12 has input terminals (no numerals) connected to the output terminals 18 and 18' of the full-wave rectifier 16. A filter inductor 24 and a semiconductor switching circuit 26 are connected in series to terminals 18 and 18'. The semiconductor switching circuit 26 is composed of a silicon controlled rectifier 28 and a diode 30. The silicon controlled rectifier 28 has its gate electrode connected to a gate pulse supply circuit or oscillator 32 so as to be intermittently triggered at high frequency. Across the switching circuit 26 is connected a commutating network consisting of a commutating inductor 34 and a commutating capacitor 36. The static power converter 12 thus arranged has its output terminals (no numerals) connected to the induction heating unit 14. The induction heating unit 14** comprises a first series combination of a filter capacitor 38 and a heater coil 40 and a second series combination of a filter capacitor 38' and a heater 40'. The first and second series combination of the filter capacitors 38 and 38' and the heater coils 40 and 40' are connected in parallel between the output terminals of the static power inverter 12 or, more specifically, across the commutating capacitor 36 of the power inverter 12 over switching elements 82 and 82', respectively. The heater coils 40 and 40' are, furthermore, connected in parallel to each of the filter capacitors 38 and 38' over a series combination of switching elements 84 and 84', as shown. The switching elements 82 and 84 associated with one heater coil 40 are operatively connected by a mechanical or magnetic linkage 86 to a switch control circuit 90 and likewise the switching elements 82' and 84' associated with the other heater coil 40' are operatively connected by a mechanical or magnetic linkage 88 to the above-mentioned switch control circuit 90. The switch control circuit 90 has a first set of terminals connected through a first timer 92 across a switch 94 associated with the heater coil 40 and a second set of terminals which are similarly connected through a second timer 92' across a switch 94' associated with the heater coil 40'. Each of the switches 94 and 94' may therefore be preferably constituted by the magnetically actuated switching arrangement which will be discussed in connection with FIG. 2.

Figure 2:
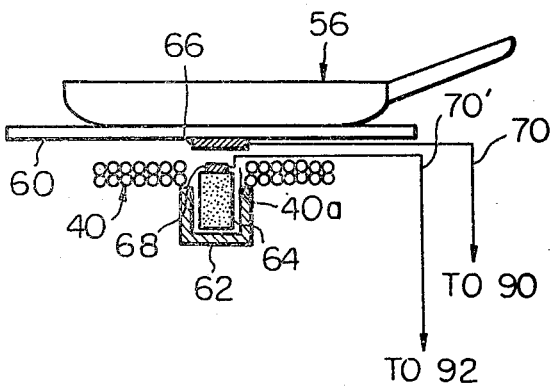
FIG. 2 is a side elevational view showing, partly in section, a preferred example of a magnetically operated switching arrangement incorporated into the embodiment shown in FIG. 1.

FIG. 2 illustrates a practical example of the switching element 94. The heater coil 40 is wound in a spiral form having an opening 40*a* formed in the central area thereof and is positioned below a flat supporting plate 60 which is constructed of a heat-resistive and non-magnetic material. Underneath the central opening 40*a* of the spiral heater coil 40 is positioned a hollow receptacle 62 having an open top end and formed of a non-magnetic material. The receptacle 62 has loosely or vertically movably received therein a piece of permanent magnet 64 which has its top end located in the central opening 40*a* of the heater coil 40 when the piece of permanent magnet 64 rests in the receptacle 62 by reason of its own gravity. The permanent magnet 64 is, thus, held in a lowermost position resting in the receptacle in the absence of a magnetic load on the supporting plate 60 and is upwardly moved in response to a magnetic load such as a cooking pan 56 placed on the upper face of the supporting plate 60. The supporting plate 60 has fixedly attached to the lower face thereof a stationary electric contact 66 which is held in position over the central opening 40*a* of the spiral heater coil 40, whilst the permanent magnet 64 has fixedly secured to the top end thereof a movable electric contact 68 which, together with the permanent magnet 64, is vertically movable into and out of contact with the stationary contact 66 on the supporting plate in the presence and in the absence of the cooking pan 56, respectively. The stationary and movable contacts 66 and 68 thus arranged are connected to leads 70 and 70' which are connected respectively to the switch control circuit 90 and the timer 92. The switching element 94' associated with the heater coil 40' shown in FIG. 1 is constructed and arranged entirely similarly to the switching element 94 and, thus, the description thus far made in connection with the switching element 94 wholly applies to the switching element 94'.

Each of timers 92 and 92' produces an output signal when kept supplied with an input signal for more than a predetermined period of time. The output signal thus delivered from each of the timers 92 and 92' is fed into the switch control circuit 90 and actuates the same into a condition causing the switching elements 82 and 84 or the switching elements 82' and 84' to open. As a consequence, the heater coil 40 or 40' is de-energized when the switch 94 or 94' associated therewith is kept open for a certain period of time.

Figure 3:
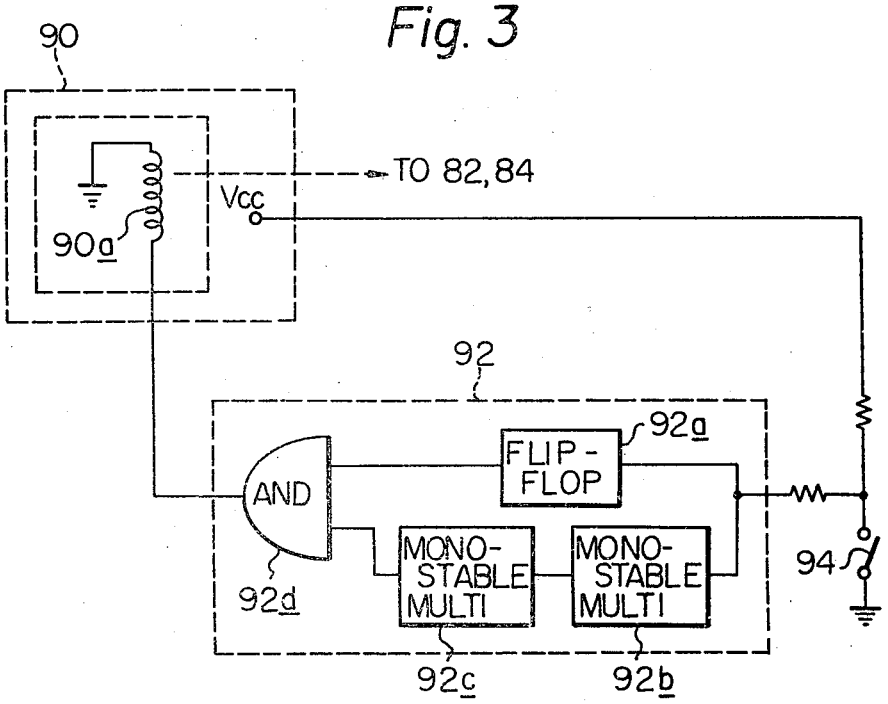
FIG. 3 is a detailed circuit configuration of elements in the preferred embodiment of FIG. 1.
Figure 4:
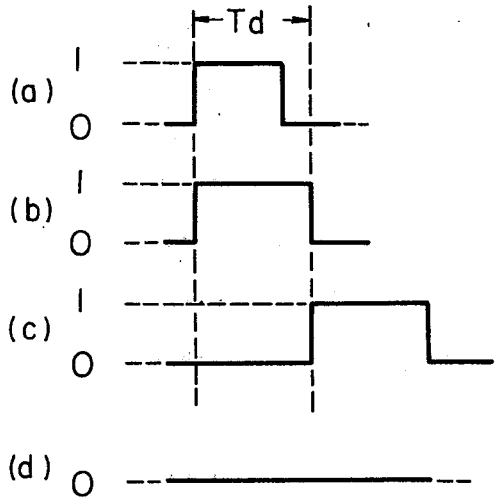
FIGS. 4 and 5 are graphs showing operation of the elements of FIG. 3.
Figure 5:
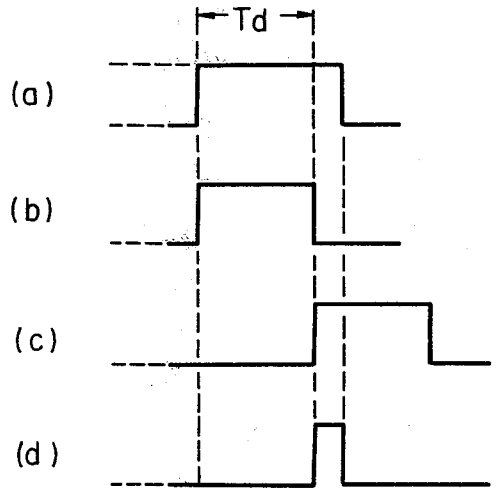

Reference is now made to FIGS. 3–5, wherein FIG. 3 illustrates a detail of the timer 92 and the switching control circuit 90. In the first place, there will be discussed a case where the opening time period of the switch 94 is less than the above-mentioned predetermined time period (hereinafter referred to as $T_d$). A flip-flop 92*a* is triggered in response to the opening of the switch 94 and rest in response to the closing of the same (FIG. 4(*a*)). On the other hand, a monostable multivibrator 92*b* is also triggered in response to the opening of the switch 94 to generate an output therefrom for the predetermined time period $T_d$ (FIG. 4(*b*)). The trailing edge of the output of the monostable multivibrator 92*b* triggers another monostable multivibrator 92*c* which generates an output for a predetermined time period (FIG. 4(*c*)). The outputs of the flip-flop 92*a* and the monostable multivibrator 92*c* are then fed to an AND gate 92*d*. In this instance, the AND gate 92*d* does not receive a logic "1" at the same time, so that the output thereof is a logic "0" (FIG. 4(*d*)). This means that a coil 90*a* of the switch control circuit 90 is not energized, resulting in the fact that the switches 82 and 84 remain closed. On the other hand, when the opening time period of the switch 94 is more than the predetermined time period $T_d$, the time duration of the output of the flip-flop 92*a* becomes as shown in FIG. 5(*a*). Therefore, the AND gate 92*d* generates a logic "1" (FIG. 5(*d*)), thereby to energize the coil 90*a*. This means that the coil 90*a* actuates the switches 82 and 84 each of which is usually of a self-retaining type. The timer 92' is constructed and arranged entirely similarly to the timer 92 so that further description with respect to the timer 92' will be omitted.

As a consequence, the heater coil 40 in an unloaded condition is disconnected from the power inverter 12 whether the switching elements 82' and 84' associated with the other heater coil 40' are open or closed. When one of the heater coils 40 and 40' is energized and the other thereof is de-energized, either of the switching elements 84 and 84' is open so that the former heater coil is connected to the power inverter 12 through the filter capacitor 38 or 38' associated with the heater coil. When, however, both of the heater coils 40 and 40' are energized simultaneously with all of the switching elements 82 and 82' and the switching elements 84 and 84' kept closed, the heater coils 40 or 40' are connected in parallel to the power inverter through the filter capacitors 38 and 38', respectively. The switches 84 and 84' are thus adapted to prevent each of the heater coils 40 and 40' from being subjected to an increased load impedance when one of the heater coils 40 and 40' is energized with the other of the heater coils de-energized. The switching elements 84 and 84' may therefore be dispensed with if such a consideration need not be paid.

It is understood from the foregoing that, according to the present invention, the temporary removal of the pan 56 from the top plate 60 for less than the predetermined time period does not cause the heater coil 40 and/or 40' to be de-energized, whilst the temporary removal of the pan 56 from the top plate 60 for more than the predetermined time period causes the heater coil 40 and/or 40' to be de-energized during a certain time period.

What is claimed is:

1. An induction heating apparatus comprising;

a d.c. power supply circuit, a static power inverter connected to the d.c. power supply circuit for producing a high-frequency oscillating current, an induction heating unit having a plurality of heater coils connected to the static power inverter for producing a commutating magnetic field around each of the heater coils, capacitors respectively connected in series with the heater coils, a plurality of first switches each connected between the static power inverter and each of the heater coils, a plurality of second switches each provided in the vicinity of each of the plurality of the heater coils and responsive to removal of a load to be heated from its corresponding heater coil to be rendered open, a plurality of timing circuits respectively connected in series with the second switches, each of the timing circuits producing an output signal in response to a condition in which the corresponding one of the second switches is kept open for a predetermined period of time, a switch control circuit having input terminals connected to the timing circuits, being linked with the first switches through respective linkage linking the first switches to the switch control circuit, and being actuated by the output signal from each of the timing circuits so that the first switch associated with the timing circuit delivering the output signal is rendered open, and a plurality of third switches connected in series and provided between junctions defined by the capacitors and the heater coils, each of the third switches being linked to the switch control circuit through respective said linkages for being rendered open when the first switch associated with the timing circuit delivering the output signal is rendered open by means of the switch control circuit.

* * * * *